US010502158B2

(12) United States Patent
Malischewski et al.

(10) Patent No.: US 10,502,158 B2
(45) Date of Patent: Dec. 10, 2019

(54) PISTON FOR A RECIPROCATING-PISTON INTERNAL COMBUSTION ENGINE

(71) Applicant: MAN Truck & Bus AG, München (DE)

(72) Inventors: Thomas Malischewski, Heilsbronn (DE); Jürgen Ritter, Nürnberg (DE)

(73) Assignee: MAN TRUCK & BUS AG, Munich (DE)

( * ) Notice: Subject to any disclaimer, the term of this patent is extended or adjusted under 35 U.S.C. 154(b) by 108 days.

(21) Appl. No.: 15/433,709

(22) Filed: Feb. 15, 2017

(65) Prior Publication Data

US 2017/0241373 A1 Aug. 24, 2017

(30) Foreign Application Priority Data

Feb. 18, 2016 (DE) ..... 10 2016 001 926

(51) Int. Cl.
*F02F 3/22* (2006.01)
*F02F 3/00* (2006.01)

(52) U.S. Cl.
CPC ..... *F02F 3/22* (2013.01); *F02F 3/0076* (2013.01)

(58) Field of Classification Search
CPC .... F02F 3/22; F02F 3/0076; F02F 2003/0061; F01P 3/10; F01M 1/16; F01M 2250/62
USPC ..... 123/41.39
See application file for complete search history.

(56) References Cited

U.S. PATENT DOCUMENTS 4,493,292 A * 1/1985 Showalter ..... F02F 3/18 123/193.6
5,070,768 A * 12/1991 Goncalves ..... F02F 3/003 123/41.35
6,477,941 B1 11/2002 Zhu et al.
6,532,913 B1 3/2003 Opris
6,651,549 B2 11/2003 Zhu et al.
9,073,534 B2 7/2015 Okada et al.
2002/0046593 A1* 4/2002 Ribeiro ..... B21K 1/18 72/377
2002/0189442 A1 12/2002 Zhu et al.
(Continued)

FOREIGN PATENT DOCUMENTS

DE 733038 3/1943
DE 733038 C 3/1943
(Continued)

OTHER PUBLICATIONS

German Search Report issued in corresponding application No. 102016001926.3 dated Jan. 4, 2017.
(Continued)

*Primary Examiner* — Joseph J Dallo
*Assistant Examiner* — Yi-Kai Wang
(74) *Attorney, Agent, or Firm* — Weber Rosselli & Cannon LLP

(57) ABSTRACT

The present disclosure relates to a piston for a reciprocating-piston internal combustion engine, comprising a piston head and a piston barrel, wherein the piston head has an encircling ring belt with at least one ring groove for a piston ring and has, in the region of the ring belt, an encircling cooling duct. The cooling duct extends from the ring belt as far as a wall of the piston barrel in order to increase an oil film temperature of the oil film in the cylinder liner between the piston barrel and cylinder and to thereby reduce the piston barrel friction.

18 Claims, 9 Drawing Sheets

(56) References Cited

U.S. PATENT DOCUMENTS

| | | | | |
|---|---|---|---|---|
| 2007/0022981 | A1* | 2/2007 | Ernst | F01M 1/08 123/41.35 |
| 2009/0151555 | A1* | 6/2009 | Lapp | F02F 3/003 92/172 |
| 2012/0285404 | A1* | 11/2012 | Scharp | F02F 3/22 123/41.39 |
| 2013/0186365 | A1* | 7/2013 | Laimboeck | F02F 3/00 123/193.6 |
| 2013/0192545 | A1 | 8/2013 | Bidner et al. | |
| 2014/0020648 | A1* | 1/2014 | Azevedo | F16J 9/062 123/193.6 |
| 2015/0019091 | A1 | 1/2015 | Okada et al. | |
| 2015/0128892 | A1* | 5/2015 | Bischofberger | F02F 3/18 123/193.6 |
| 2015/0198081 | A1* | 7/2015 | Surnilla | F02D 41/3094 123/294 |
| 2015/0247475 | A1* | 9/2015 | Bischofberger | F02F 3/18 123/41.35 |

FOREIGN PATENT DOCUMENTS

| | | | |
|---|---|---|---|
| DE | 3506399 | A1 | 8/1986 |
| DE | 3922473 | A1 | 1/1990 |
| DE | 4018252 | A1 | 12/1991 |
| DE | 4243571 | A1 | 6/1994 |
| DE | 60028800 | T2 | 5/2007 |
| DE | 102011012686 | A1 | 9/2012 |
| DE | 102014010106 | A1 | 1/2015 |
| EP | 0189767 | A2 | 8/1986 |
| GB | 493126 | A | 9/1938 |
| JP | S54116516 | A | 9/1979 |
| JP | 2002-250211 | A | 9/2002 |
| JP | 2006-226152 | A | 8/2006 |
| JP | 2011256812 | A | 12/2011 |
| JP | 2013209903 | A | 10/2013 |
| WO | 2007/028364 | A1 | 3/2007 |
| WO | 2012/116688 | A1 | 9/2012 |

OTHER PUBLICATIONS

Extended European search report issued in corresponding application No. 17153761.6 dated Jul. 17, 2017.

European Office Action issued in corresponding EP Application No. 17153761.6 dated Jan. 16, 2019, 4 pages; English translation not available.

* cited by examiner

PISTON FOR A RECIPROCATING-PISTON INTERNAL COMBUSTION ENGINE

BACKGROUND

1. Technical Field

The present disclosure relates to a piston for a reciprocating-piston internal combustion engine.

2. Description of Related Art

Pistons for a reciprocating-piston internal combustion engine are known from the prior art, for example the laid-open specification DE 10 2014 010 106 A1. A piston of said type is normally arranged in a cylinder of a reciprocating-piston internal combustion engine. The piston has a piston barrel which is normally also referred to as "body" or "piston body". In English, the piston barrel is referred to as "piston skirt". Furthermore, the piston has a ring belt which adjoins the piston barrel in an axial direction of the piston and which has at least one ring groove for a piston ring. The ring belt is part of the piston head.

The friction of an internal combustion engine is made up of the friction of the main engine (bearings, piston group) and the drive power of the auxiliary assemblies. Here, approximately 30% of the total friction arises in the piston group, wherein the piston barrel accounts for approximately ⅔ of the friction of the piston group.

The piston barrel friction is influenced by various influential variables. For example, the piston barrel friction is dependent on the engine rotational speed, the engine load, the gap between cylinder liner and piston barrel, and the shape of the piston barrel.

SUMMARY

The present disclosure is based on the realization that the piston barrel friction is furthermore dependent on the viscosity of the oil film between piston barrel and the cylinder liner of the cylinder. The viscosity is dependent on the oil type and the oil temperature.

One aspect of the present disclosure is to provide an improved piston for a reciprocating-piston internal combustion engine, by way of which disadvantages of conventional pistons can be avoided. It is a further aspect of the present disclosure to provide a piston for a reciprocating-piston internal combustion engine with which piston barrel friction can be reduced.

Advantageous aspects and uses of the present disclosure will be discussed in more detail in the following description, in part with reference to the figures.

According to the present disclosure, a piston for a reciprocating-piston internal combustion engine is provided which is guided in slidingly movable fashion in a cylinder liner of a cylinder of the internal combustion engine and which, in a manner known per se, comprises a piston head and a piston barrel. The piston barrel serves for the guidance of the piston in the cylinder liner. The piston barrel adjoins the ring belt in an axial direction of the piston. Here, the axial direction corresponds to the direction of movement of the piston in the cylinder. It has already been stated above that the piston barrel is also referred to as piston body. The piston head is also referred to as piston crown.

The piston head has an encircling ring belt with at least one ring groove for a piston ring and has, in the region of the ring groove, an encircling fluid duct. The fluid duct is normally, and also in this document, referred to as cooling duct. The cooling duct is designed to be flowed through by a lubricant, in particular oil, and serves for the cooling of the combustion chamber depression, which is also referred to as piston depression. Here, the combustion chamber depression, which is heated as a result of the combustion process, heats the lubricant. All aspects in this document in which oil is used as a highlighted lubricant example also apply to other lubricants.

On the piston head, there may be provided an inlet bore via which the lubricant can flow into the cooling duct. Furthermore, an outflow bore may be provided, for example so as to be offset through 180° in a circumferential direction with respect to the inlet bore, via which outflow bore lubricant can emerge from the cooling duct.

According to general aspects of the present disclosure, the cooling duct extends from the ring belt as far as a wall of the piston barrel. The cooling duct is thus arranged not only in the region of the ring belt or of the piston head but also extends further downward into the region of the piston barrel. Here, "downward" means away from the piston head in the direction of the crankshaft connecting rod, or in the direction of the piston pin.

A cooling duct which extends as far as a wall of the piston barrel offers the advantage that the lubricant which is heated in the cooling duct in the region of the ring belt is conducted through the cooling duct to the wall of the piston barrel, whereby an energy transfer for heating the piston barrel is made possible. The additional heating of the piston barrel that is achieved in this way increases the oil film temperature between piston barrel and cylinder liner of the cylinder, whereby a reduction of the piston barrel friction is achieved. The higher the temperature of the oil film between piston barrel and cylinder liner, the lower the piston barrel friction. In particular in operating modes with very high load, it is possible by way of the lower region of the cooling duct for the piston body temperature to be reduced, and in this way for thermal damage of the oil film between cylinder liner and piston body to be avoided. Correspondingly to this conventional designation of the fluid duct as a cooling duct, that section of said fluid duct which extends, according to the present disclosure, as far as the wall of the piston barrel is referred to as part of the cooling duct, even though said section serves for supplying the lubricant that is heated in the upper region of the cooling duct to the piston barrel and heating said piston barrel, and thus actually serves as a "heating duct".

The cooling duct may extend as far as a wall, arranged below the ring belt, of the piston barrel. The cooling duct preferably extends as far as below the ring belt. The piston barrel may have a pin bore for receiving a piston pin. The cooling duct may be formed in encircling fashion in the region of the ring belt, that is to say the cooling duct extends in the circumferential direction of the piston, preferably in encircling fashion through 360°, such that the cooling duct runs in ring-shaped fashion in the ring belt. The lower part of the cooling duct, that is to say the part which extends from the cooling duct in the region of the ring belt as far as a wall of the piston barrel, preferably does not extend in encircling fashion through 360°.

In a particularly advantageous aspect, the cooling duct extends as far as a lower end region, which is averted from the ring belt, of the wall of the piston barrel, in order that, in this way, said cooling duct can heat the piston barrel over the entire axial length thereof. Alternatively, the cooling duct may extend along at least 50% of the axial length of the piston barrel, more preferably along at least ⅔ of the axial length or furthermore preferably at least along ⅘ of the axial length of the piston barrel.

It has already been mentioned above that the piston barrel has at least one pin bore for receiving a piston pin. In a further aspect, the cooling duct may extend in the axial direction of the piston as far as the level of the at least one pin bore. It is particularly advantageous if the cooling duct extends in the axial direction of the piston as far as a lower end of the pin bore. Here, the lower end of the pin bore is that end which faces toward a connecting rod which engages on the piston.

The cooling duct may be, in the region of the wall of the piston barrel, fluidically connected by way of at least one first passage opening to a cylinder liner for the piston. In other words, the piston barrel or the wall of the piston barrel has a passage opening, for example in the form of a passage bore, via which lubricant can pass from the cooling duct to the cylinder liner of the piston. In this way, hot lubricant that is heated in the upper region of the cooling duct can be conducted in the cooling duct directly to the piston barrel, such that the temperature of the piston barrel can be increased even more efficiently. In this way, it is consequently possible to achieve an even better reduction of the piston barrel friction. It is thus possible for heated lubricant to pass through the at least one first passage opening to the cylinder liner of the piston. The at least one first passage opening may be arranged in a middle region of the piston barrel, preferably in the middle of the height of the piston barrel, in the axial direction.

In an advantageous variant aspect, a rib is arranged in the cooling duct such that the oil flow to the cylinder liner is intensified. The rib will hereinafter be referred to as oil-catching rib. The expression "lubricant-catching rib" is to be regarded as synonymous for this. This may be realized in particular by virtue of the oil-catching rib being arranged in the cooling duct such that a part of the oil flung back and forth in the cooling duct as a result of the piston movement strikes the oil-catching rib or is caught on the oil-catching rib and is conducted by the oil-catching rib to the at least one first passage opening. The flinging of the lubricant back and forth in the cooling duct owing to the upward and downward movement of the piston is also referred to as "shaker motion". The oil-catching rib is thus arranged in the region of the at least one first passage opening such that a part of the lubricant is caught on the oil-catching rib during the shaker motion and can then flow along the rib to the at least one first passage opening.

The rib may project from the wall of the piston barrel towards the piston interior from the wall of the piston barrel. The rib may also be in the form of a web or projection which projects from the wall of the piston barrel toward the piston interior proceeding from the wall of the piston barrel.

Here, the oil-catching rib may be arranged at the level of or directly adjacent to the at least one first passage opening. It is thus possible for oil that strikes the oil-catching rib to be conducted to the at least one first passage opening in an efficient manner.

In accordance with one aspect of the disclosure, the oil-catching rib is arranged such that a lower edge of the first passage opening is arranged so as to be downwardly offset in the axial direction with respect to a horizontal oil-intercepting or lubricant-intercepting surface of the oil-catching rib. This offers the advantage that, even in the case of a low oil level on the oil-catching rib, a large transition cross section to the first passage opening is already opened up. Here, the first passage opening is preferably in the form of a passage bore such that the passage bore extends on the inner side of the piston barrel into a region of the oil-catching rib and forms a duct-like recess there in the form of an open duct for receiving the intercepted oil or lubricant.

In a further particularly advantageous variant, at least one second passage opening may be provided in the cooling duct in the region of the wall of the piston barrel, by way of which second passage opening the cooling duct is fluidically connected to the cylinder liner. The at least one first passage opening and the at least one second passage opening are arranged in each case on opposite sides of the oil-catching rib in the axial direction of the piston. This offers the advantage that lubricant which is caught on the oil-catching rib during the upward movement of the piston and lubricant which is caught on the oil-catching rib during the downward movement of the piston can pass to the running surface of the piston. It is thus possible, during the shaker motion of the lubricant, for lubricant which is caught on the top side of the oil-catching rib to pass to the running surface through those passage openings which are arranged adjacent to the top side of the oil-catching rib, whereas lubricant which is caught on the bottom side of the oil-catching rib during the downward movement of the piston can pass to the running surface through those passage openings which are arranged adjacent to the oil-catching rib below the latter in the axial direction.

In this further variant, the oil-catching rib is thus arranged between the at least one first passage opening and the at least one second passage opening, preferably in each case directly adjacent and/or next to the at least one first passage opening and the at least one second passage opening. It is preferable for multiple such first and/or second passage openings to be arranged so as to be distributed in the circumferential direction, preferably along a circular line, in order to increase the heat transfer from the cooling duct to the cylinder liner.

The oil-catching rib may be formed in encircling fashion in the circumferential direction of the piston on that wall of the piston barrel which adjoins the cooling duct. Here, the circumferential direction lies in a plane perpendicular to the axial direction of the piston.

Furthermore, the oil-catching rib may have a first section, which runs in encircling fashion on the wall of the piston barrel and which extends in a radial direction of the piston, and a second section, which extends in the axial direction of the piston, wherein the second section is arranged at that end region of the first section which is averted from the wall of the piston barrel. This makes it possible for lubricant that is flung back and forth to be caught in a particularly effective manner and for the caught lubricant to be supplied to the respective passage opening in the piston barrel. Here, the radial direction is perpendicular to the axial direction.

Here, a further advantageous possibility for the realization according to the present disclosure of an oil-catching rib provides that the second section of the oil-catching rib extends in the axial direction both in the direction of the piston head and in the opposite direction, that is to say in the direction of the crankshaft. This design variant is particularly advantageous if it is the intention for lubricant to be caught, and supplied to a passage opening, both in part during the upward movement and in part during the downward movement of the piston.

In a further aspect of the disclosure, the wall of the piston barrel may have a profiling on a side facing toward the cooling duct, wherein the profiling is preferably formed by a channel structure. The profiling increases the surface area of the wall of the cooling duct on the side of the piston barrel, whereby the heat transfer to the piston barrel is increased by way of the lubricant that is caught on the profiling.

In a further aspect of the disclosure, the piston barrel may have, on its outer surface, a depression which surrounds an end region, that is to say the end region adjoining the cylinder liner of the piston, of the at least one first passage bore. The outer surface of the piston barrel is to be understood to mean that surface of the piston barrel which faces toward the cylinder liner. The depression may be in the form of a groove or channel. The depression may in particular be in the form of a wide shallow channel. This also reduces the fluid shear surfaces.

A corresponding depression may also be provided for the at least one second passage opening. The depression improves the distribution of lubricant, which emerges from the end region of the at least one first passage opening and/or of the at least one second passage opening, between cylinder liner and piston barrel.

In a further advantageous aspect of the disclosure, a further passage opening, in particular a passage bore, may be provided, said further passage opening being provided on a wall, situated opposite the piston barrel, of the cooling duct. Said passage opening will hereinafter also be referred to as lubricant return bore. The lubricant can flow back to the piston interior through said lubricant return bore. Said lubricant return bore is preferably positioned such that an oil level advantageous for temperature transport is set in the cooling duct, which may be realized for example by adaptation of the spacing of the lubricant return bore from the lower end of the cooling duct.

Here, said passage opening is arranged, in the axial direction of the piston, so as to be spaced apart from the lower end of the cooling duct and below the at least one first passage opening. The lower end of the cooling duct is that end which is furthest removed from the piston head. The lubricant return bore is thus arranged on that side of the cooling duct which faces toward the inner side of the piston.

Here, it may be advantageous if the lubricant return bore runs obliquely downward from the wall of the cooling duct to a piston interior space, because this is advantageous from a production aspect, because in this case, no angle head drill is required.

In a further advantageous variant, a wall section of the cooling duct, which wall section connects an upper region of the cooling duct, which is formed in encircling fashion in the region of the ring belt, to a lower region of the cooling duct, which adjoins the wall of the piston barrel, is designed such that the lubricant is flung against the wall of the piston barrel. Said part of the wall of the cooling duct will hereinafter be referred to as transition wall section. The transition wall section is preferably designed so as to form a ski-jump-like structure. For example, the transition wall section of the cooling duct is designed so as to have a section which runs obliquely downward toward the piston barrel and which is adjoined, in the lower region of the cooling duct, by a wall of the cooling duct, which wall runs downward more steeply in relation to said section and is arranged so as to be situated opposite the piston barrel, wherein the transition region between the wall section of the cooling duct and the wall which runs downward more steeply in relation to said section forms an edge. The obliquely downwardly running section of the transition wall section may for example have the shape of a shell surface of a frustrum. In the case of this aspect, the lubricant is thus flung against the wall of the piston barrel in a particularly efficient manner during the shaker motion, such that the heat transfer is improved.

A further aspect of the present disclosure relates to an arrangement comprising a piston as described in this document. The arrangement furthermore comprises a volume-flow-regulated lubricant pump which is provided for the supply of a lubricant to the piston, and a control device of the lubricant pump, wherein the control device is designed such that, in a manner dependent on an operating parameter of an internal combustion engine, from which operating parameter the present engine load can be derived, said control device controls or regulates a lubricant volume flow for the supply of lubricant to the piston such that, in the presence of a first value of the operating parameter, which corresponds to a first engine load, a first volume flow is set, and in the presence of a second value of the operating parameter, which corresponds to a second engine load greater than the first engine load, a second volume flow is set which is greater than the first volume flow. In this way, the oil volume flow via the oil spray nozzle can be regulated such that an advantageous oil temperature is set at the cooling duct. In the presence of low engine load, therefore, a small volume flow of the lubricant is set, and in the presence of high engine load, therefore, a correspondingly large volume flow of the lubricant is set.

A further aspect of the present disclosure relates to a motor vehicle, in particular a utility vehicle, having a piston as disclosed in this document.

BRIEF DESCRIPTION OF THE DRAWINGS

The above-described aspects and features of the present disclosure may be combined with one another in any desired manner. Further details and advantages of the present disclosure will be described below with reference to the appended drawings, in which.

Identical or functionally equivalent elements are denoted by the same reference designations throughout the figures, and in some cases, will not be described separately.

DETAILED DESCRIPTION

Figure 1:
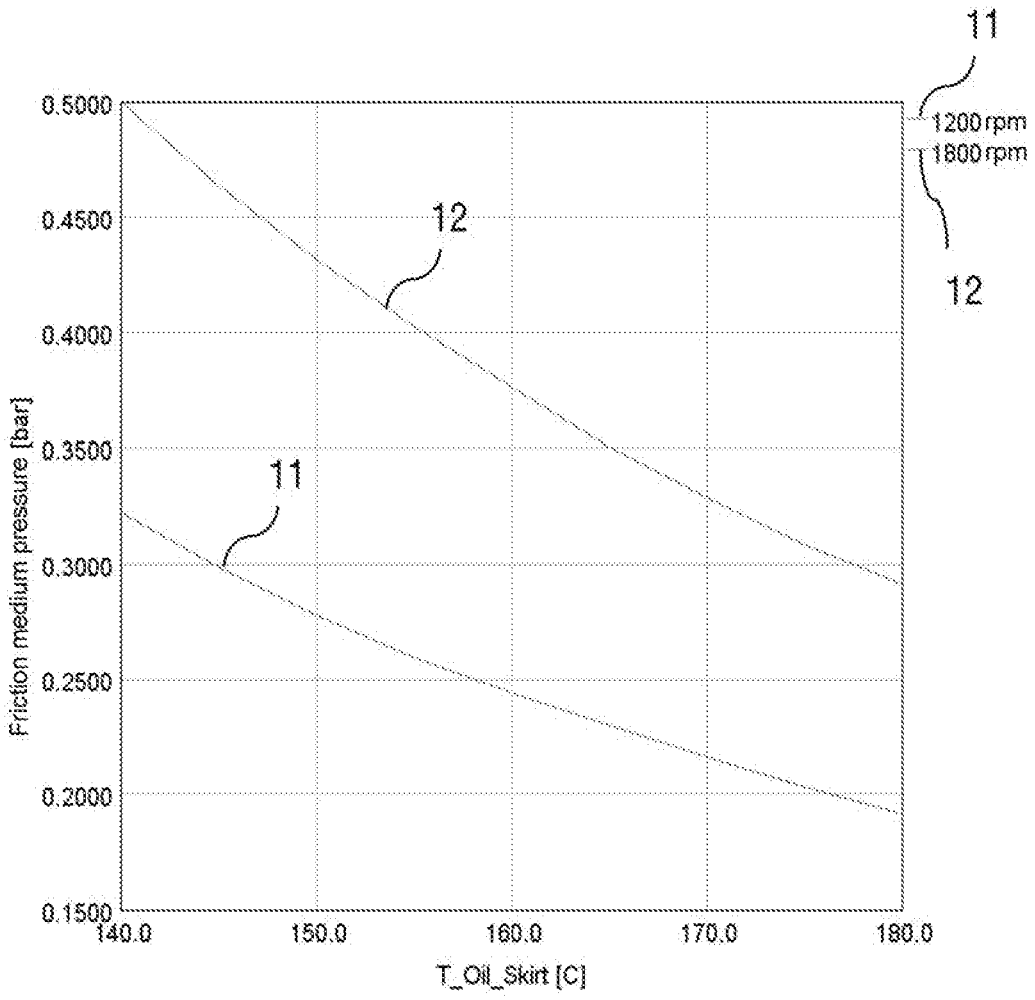
FIG. 1 shows the temperature dependency of the piston barrel friction on the oil film temperature.

FIG. 1 illustrates the piston barrel friction as a function of the oil film temperature between piston barrel and cylinder liner. The oil film temperature is plotted on the abscissa axis. Here, the corresponding friction medium pressure is plotted on the ordinate axis. The curve profile 11 corresponds to an engine rotational speed of 1200 rpm, and the curve profile 12 corresponds to an engine rotational speed of 1800 rpm. As can be seen from the diagram of FIG. 1, the friction medium pressure decreases with increasing temperature of the oil film. To minimize said piston barrel friction, it is provided according to the present disclosure that the heated returning oil is conducted in targeted fashion from the piston cooling duct to the piston barrel. In this way, the oil film temperature between piston and cylinder liner increases, which leads to lower friction.

Figure 2:
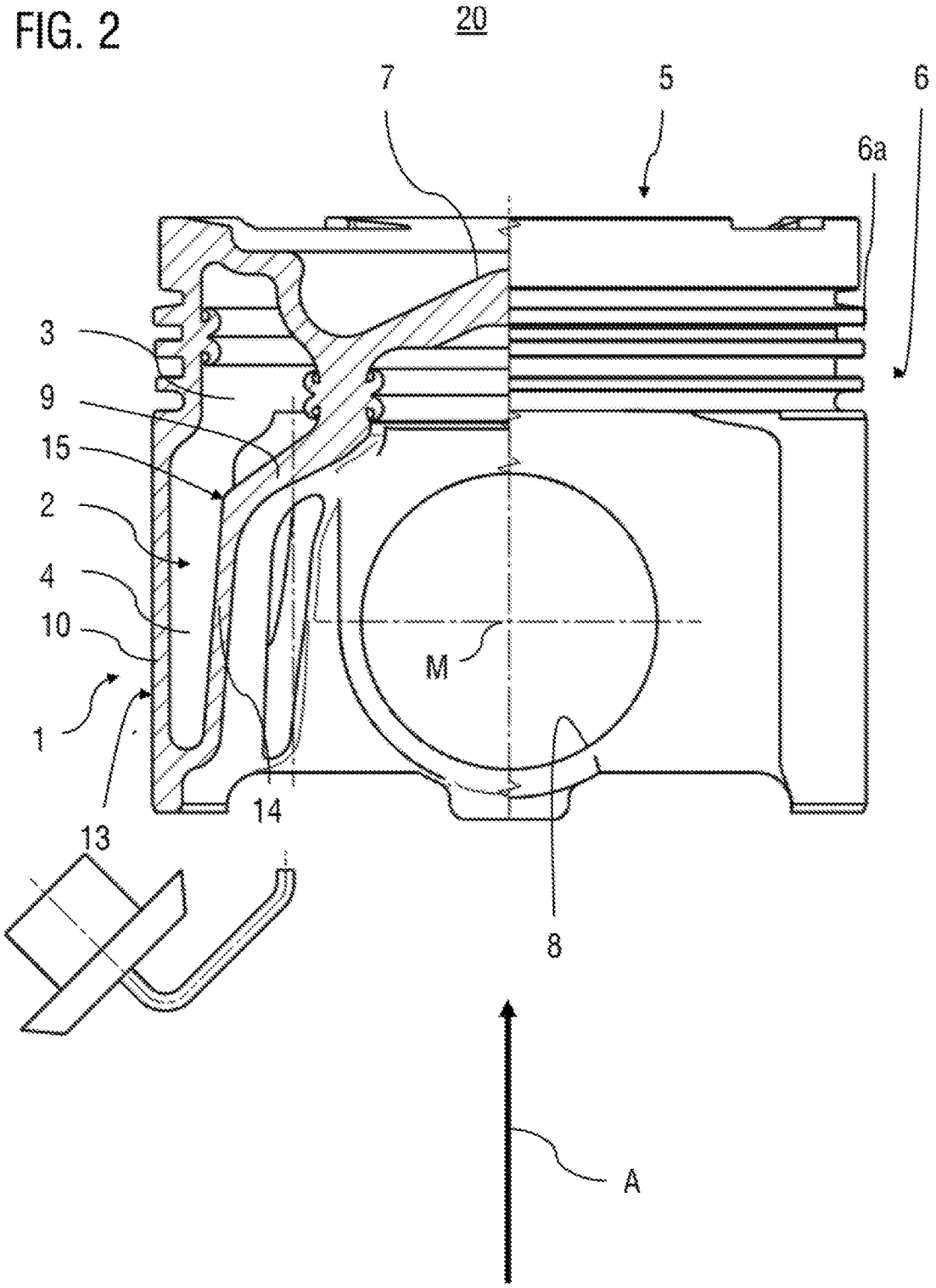
FIG. 2 shows a subsection of a piston according to an aspect of the present disclosure.

FIG. 2 shows a subsection of a first aspect of the present disclosure. The piston 20 comprises a piston head 5 which has an encircling ring belt 6. The ring belt 6 comprises at least one ring groove 6*a* for a piston ring. In the exemplary aspect shown, three ring grooves 6*a* are provided. A compensation groove is also arranged below the three ring grooves. In the axial direction A, the ring belt 6 is adjoined, in the downward direction, by the piston barrel 1, which, by contrast to the ring belt 6, is not of fully encircling form. The piston 20 is thus not in the form of a full-skirt piston. The piston barrel 1 is slidingly mounted in the cylinder liner of the cylinder, wherein a wall 10 of the piston barrel slides back and forth along the cylinder liner during the movement of the piston. The piston 20 is mounted in a corresponding cylinder (not illustrated) of a cylinder piston housing (not illustrated) of a reciprocating-piston internal combustion engine. The piston barrel 1 has in this case at least one pin bore 8 for receiving a piston pin. A connecting rod (not illustrated) which is mounted on the crankshaft is articulatedly connected to the piston 20 by way of a piston pin of said type in order, by way of said articulated coupling, to convert the translational movements of the piston 20 in the cylinder into rotational movements of the crankshaft about the axis of rotation thereof.

In FIG. 2, it can also be seen that the piston 20 has a piston depression 7, also referred to as combustion chamber depression. The piston depression 7 is in the form of a so-called omega-shaped depression. This means that the piston depression 7 has a cross section which at least substantially has the shape of a "ω". Furthermore, it can be seen in FIG. 2 that the piston 20 has, in the ring belt, a cooling duct section 3 which can be flowed through for example by a lubricant, in particular oil. By way of the lubricant in the cooling duct section 3, the piston head 5 can be cooled. By contrast to conventional pistons 20, the piston however comprises a cooling duct 2 which extends from the ring belt 6 or from the piston head as far as a wall 10 of the piston barrel.

The cooling duct 2 therefore comprises an upper section 3, which is situated in the region of the ring belt 6, and a lower section 4, which is situated in the region of the piston barrel 1 and which adjoins a wall 10 of the piston barrel. By contrast to the upper section 3 of the cooling duct 2, which is designed so as to run in encircling fashion through 360°, the lower section 4 of the cooling duct 2 is not of fully encircling form, owing to the fact that the running surface of the piston 20 is not of fully encircling form.

In the exemplary aspect shown, the lower region of the section 4 of the cooling duct 2 extends in the axial direction A of the piston as far as the lower end 8 of the piston bore or substantially almost along the entire axial length of the piston barrel 1. Both the upper section 3 and the lower section 4 of the cooling duct 2 extend circumferentially along the outer wall of the piston 20. The aspect of FIG. 2 offers the advantage that lubricant which flows into the cooling duct 2 in the upper region 3 cools the piston head 5 and, in the process, is heated. Owing to the back and forth movement of the piston between a bottom dead centre and a top dead centre, the lubricant in the cooling duct 2 is flung back and forth ("shaker motion") such that the lubricant that is heated in the upper cooling duct region 3 also reaches the wall 10 of the piston barrel 1 and thus heats said wall. By way of the heating of the wall 10 of the piston barrel, the oil film which is situated between the outer side 13 of the piston barrel and the cylinder liner is likewise heated, whereby the friction action thereof is reduced. In this way, an effective reduction of the piston barrel friction can be realized.

It can also be seen in FIG. 2 that the transition between the upper region 3 of the cooling duct 2 and the lower region 4 of the cooling duct 2 is designed such that lubricant is conducted along a transition wall section 9 of the cooling duct 2. The transition wall section 9 is arranged on that side of the cooling duct 2 which faces toward the piston inner side, and connects the upper region 3 of the cooling duct to the lower region 4 of the cooling duct. The transition wall section 9 runs obliquely straight downward, wherein an edge 15 is formed on the end of the transition wall section 9 at the transition to the lower wall section 4 of the cooling duct. At said edge 15, the oil that flows along the transition wall section 9 is flung, with a ski-jump-like action, against the wall 10 of the piston barrel 1, such that effective wetting of the wall 10 of the piston barrel with lubricant is made possible.

Figure 3:
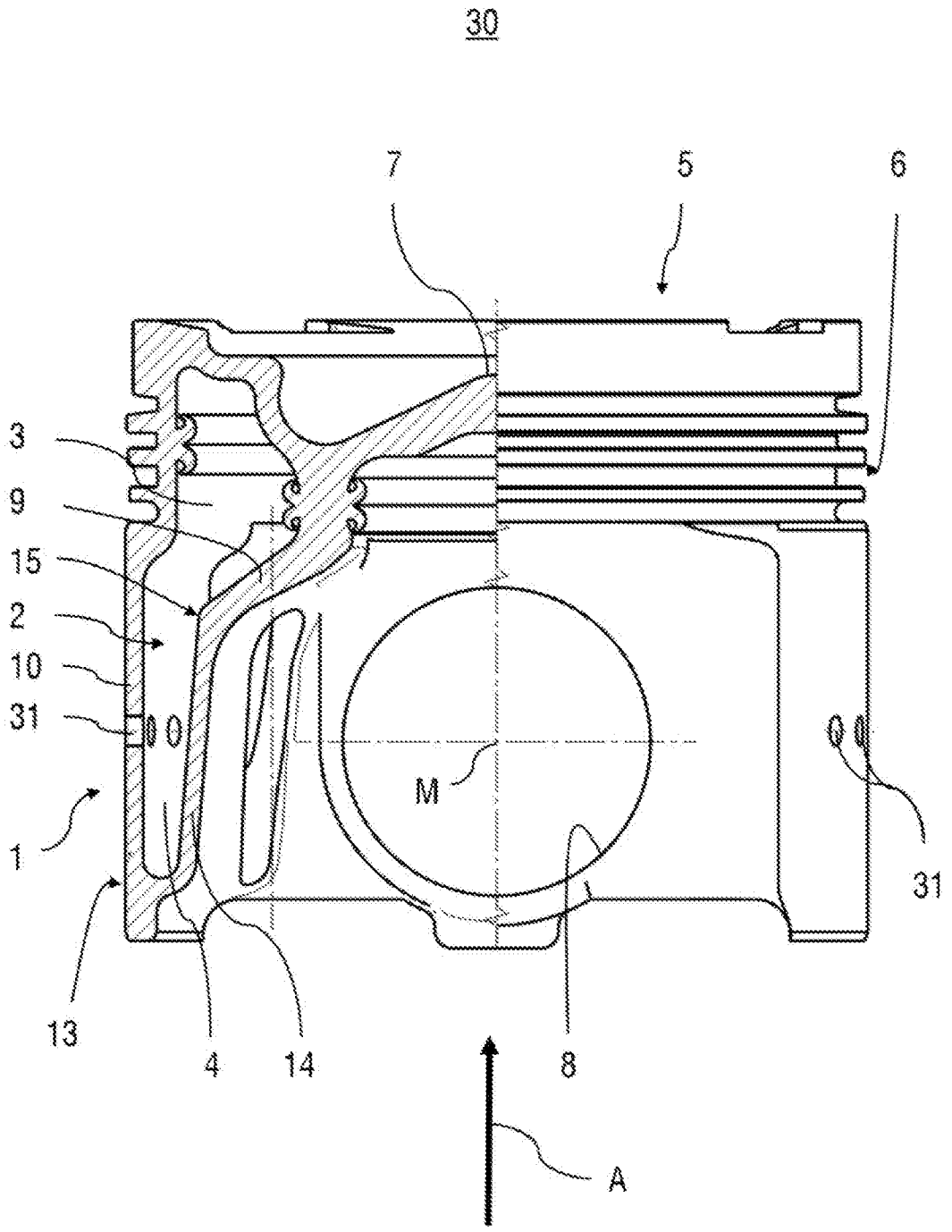
FIG. 3 shows a subsection of a piston according to a further aspect of the present disclosure.

FIG. 3 illustrates a second aspect of the piston 30.

Here, components with identical reference designations correspond to the components of FIG. 2, and will not be described separately. This correspondingly applies to FIGS. 4 to 9. For clarity, in some of the figures, reference designations have been omitted, which reference designations however emerge analogously from the other figures.

The special feature of the aspect of FIG. 3 lies in the fact that multiple passage openings 31 are formed into the wall 10 of the piston barrel. The passage openings 31 in the form of passage bores are formed into the wall 10 of the piston barrel 1 at uniform intervals along a circular line at the mid-height of the piston barrel. Via said passage openings 31, lubricant which is flung into the lower region 4 of the cooling duct 2 can pass to the cylinder liner and, there, heat up the oil film even more quickly.

Figure 4A:
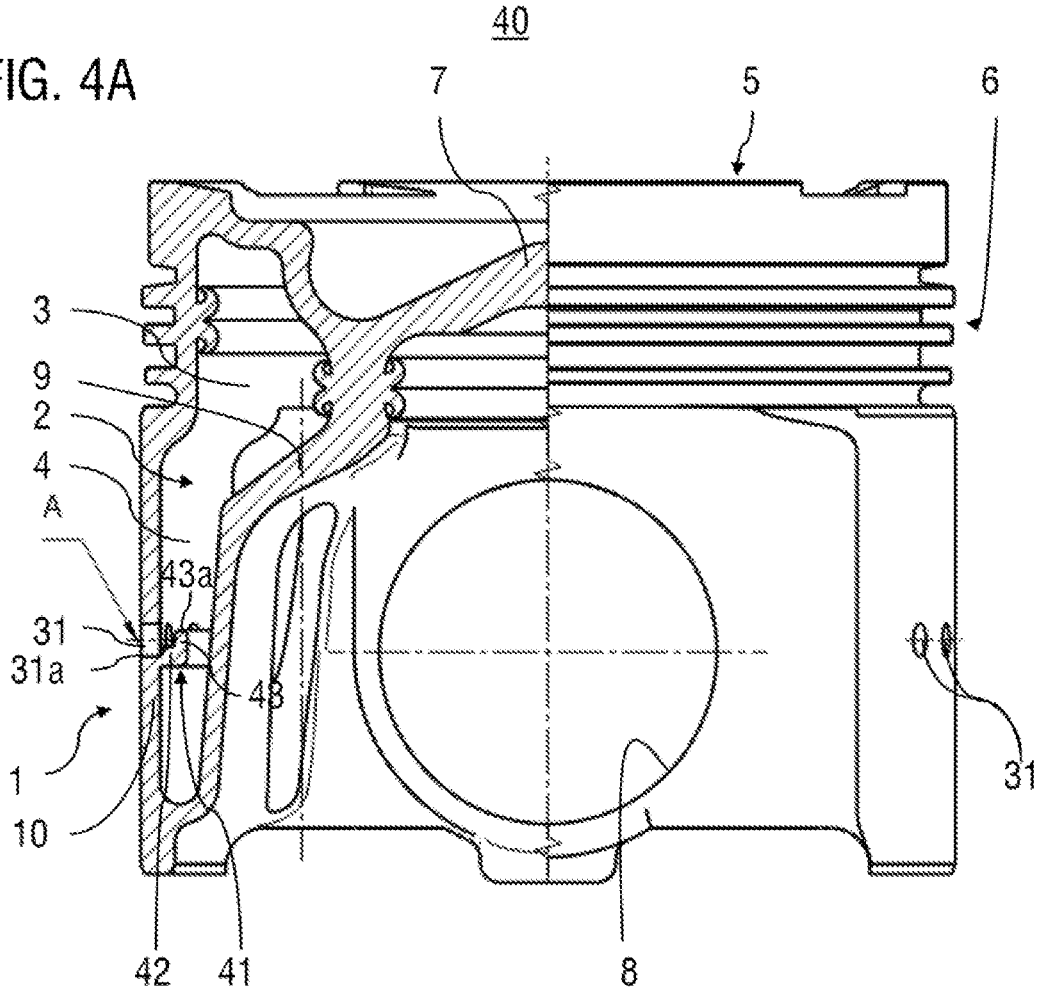
FIG. 4A shows a subsection of a piston according to a further aspect of the present disclosure.
Figure 4B:
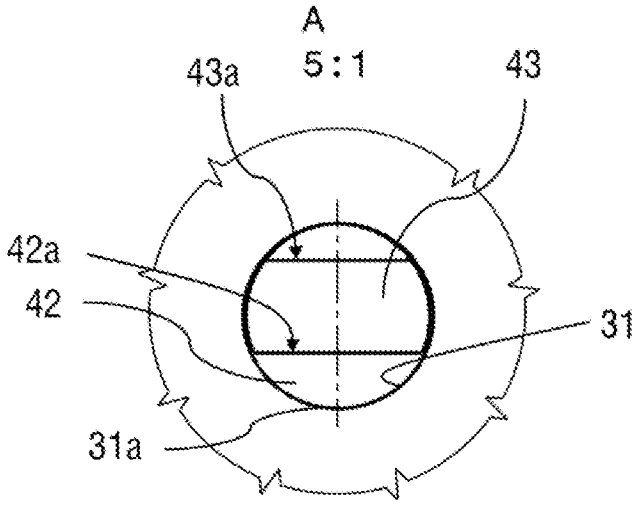
FIG. 4B shows an enlarged illustration as per the view A in FIG. 4A.

FIG. 4A and FIG. 4B illustrate a third aspect of the present disclosure. In said aspect 40, the piston 40 has, directly below and adjacent to the passage openings 31, and oil-catching rib 41 which extends in ring-segment-shaped form along the inner side of the wall 10 of the piston barrel 1. Here, the oil-catching rib 41 has a first section 42 which is fastened to the inner side of the wall 10 of the piston barrel and which, there, extends in encircling fashion in the circumferential direction at a certain axial height. Here, the first section projects from the wall 10 in the radial direction and forms a horizontal oil-catching surface 42*a*. On the distal end of the first section 42 there is formed a web 43 which points upward in the axial direction A and the length of which substantially corresponds to the radius of the passage openings 31. The upper edge of the web 43 is denoted by the reference designation 43*a*. An oil-catching rib 41 of said type offers the advantage that oil that is flung back and forth during the piston movement is partially caught on the oil-catching rib 41 and, in this way, is supplied to the passage openings 31. The provision of the oil-catching ribs thus increases the amount of lubricant which is conducted to the cylinder liner through the passage openings 31 during the piston movement. In this way, the heating effect at the cylinder liner can be increased, and thus the piston barrel friction can be further reduced.

FIG. 4B shows, in this regard, an enlarged radial view of the view A indicated in FIG. 4A. It can be seen once again that, in the radial direction toward the piston interior, the passage opening 31 is adjoined firstly by the first section 42 of the oil-catching rib 41, and the distal end of the first section 42 is adjoined by the second section 43, which extends in the axial direction. Here, the oil-catching rib 41 is arranged such that a lower edge 31*a*, that is to say lowest point, of the passage opening 31 is arranged so as to be downwardly offset in the axial direction with respect to the radial oil-intercepting or lubricant-intercepting surface 42*a* of the oil-catching rib. This offers the advantage that, even in the case of a low oil level on the oil-catching rib, a large transition cross section to the passage opening 31 is already opened up. Here, the passage opening is in the form of a passage bore such that the passage bore extends on the inner side of the piston barrel into a region of the oil-catching rib and forms a duct-like recess there in the form of an open duct for receiving the intercepted oil or lubricant.

Figure 5:
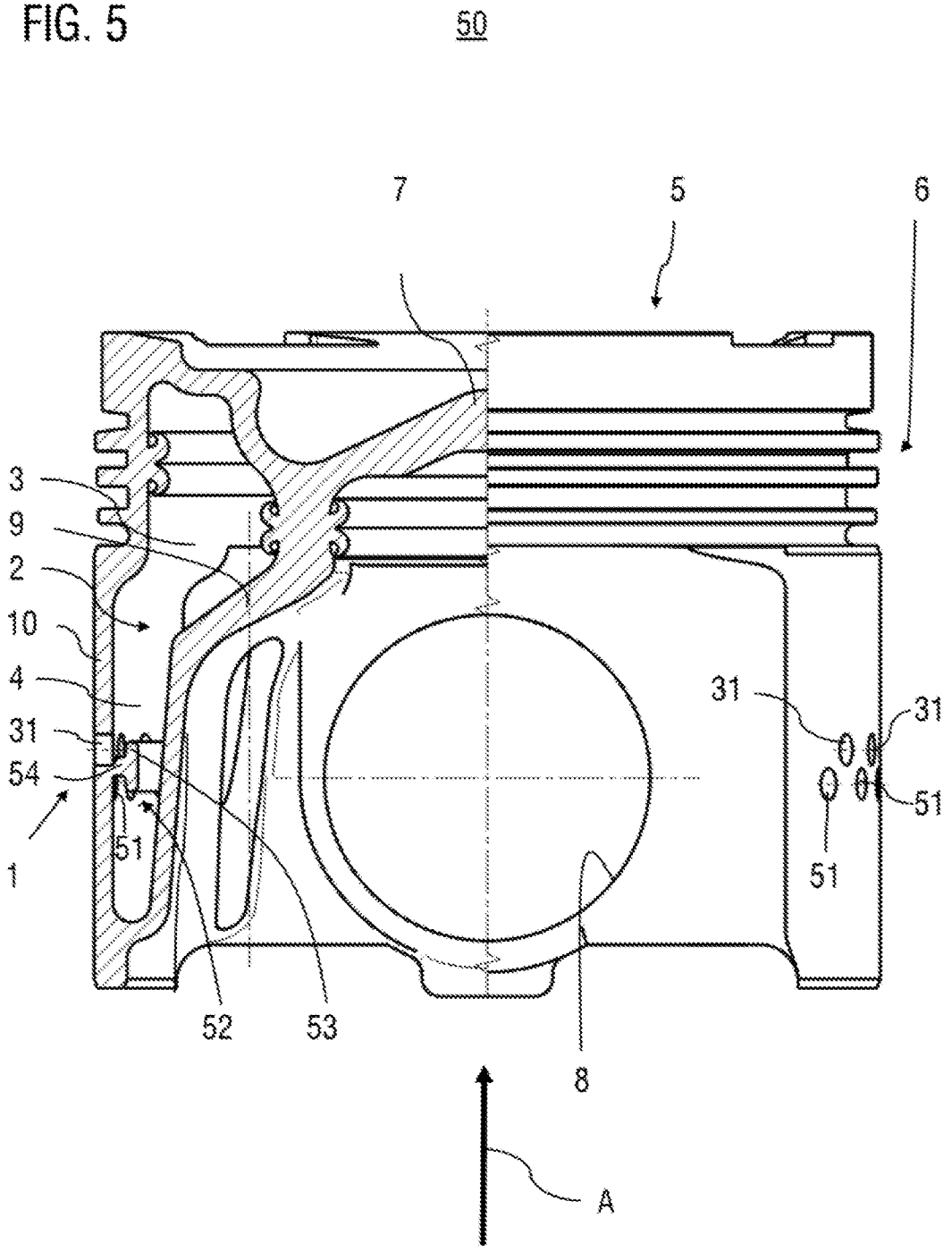
FIG. 5 shows a subsection of a piston according to a further aspect of the present disclosure.

FIG. 5 shows a fourth aspect of the present disclosure. The special feature of the piston 50 of said aspect lies in the fact that, in addition to the passage openings 31 described above, further passage openings 51 (second passage openings) are provided which—as viewed in the axial direction A—are arranged below the first passage openings 31 and are preferably arranged so as to be slightly offset with respect to the passage openings 31 in the radial direction.

A further special feature lies in the design of the oil-catching rib 52. The oil-catching rib 52 in turn has a first section 54 which extends in the radial direction away from the inner side of the wall 10 of the piston barrel. However, on the distal end of the first section 54, there is now arranged a second section 53 which extends in the axial direction, which second section extends in the axial direction both upwardly and downwardly away from the first section 54. The oil-catching rib 52 of FIG. 5 is thus of T-shaped form. This offers the advantage that, in this aspect, lubricant is intercepted by the oil-catching rib both during the upward movement and during the downward movement of the piston and is supplied either to the upper passage openings 31 or to the lower passage openings 51. In this way, the supply of lubricant that is heated in the cooling duct 2 to the cylinder liner can be yet further increased, and thus the friction-reducing effect can be yet further improved.

Figure 6:
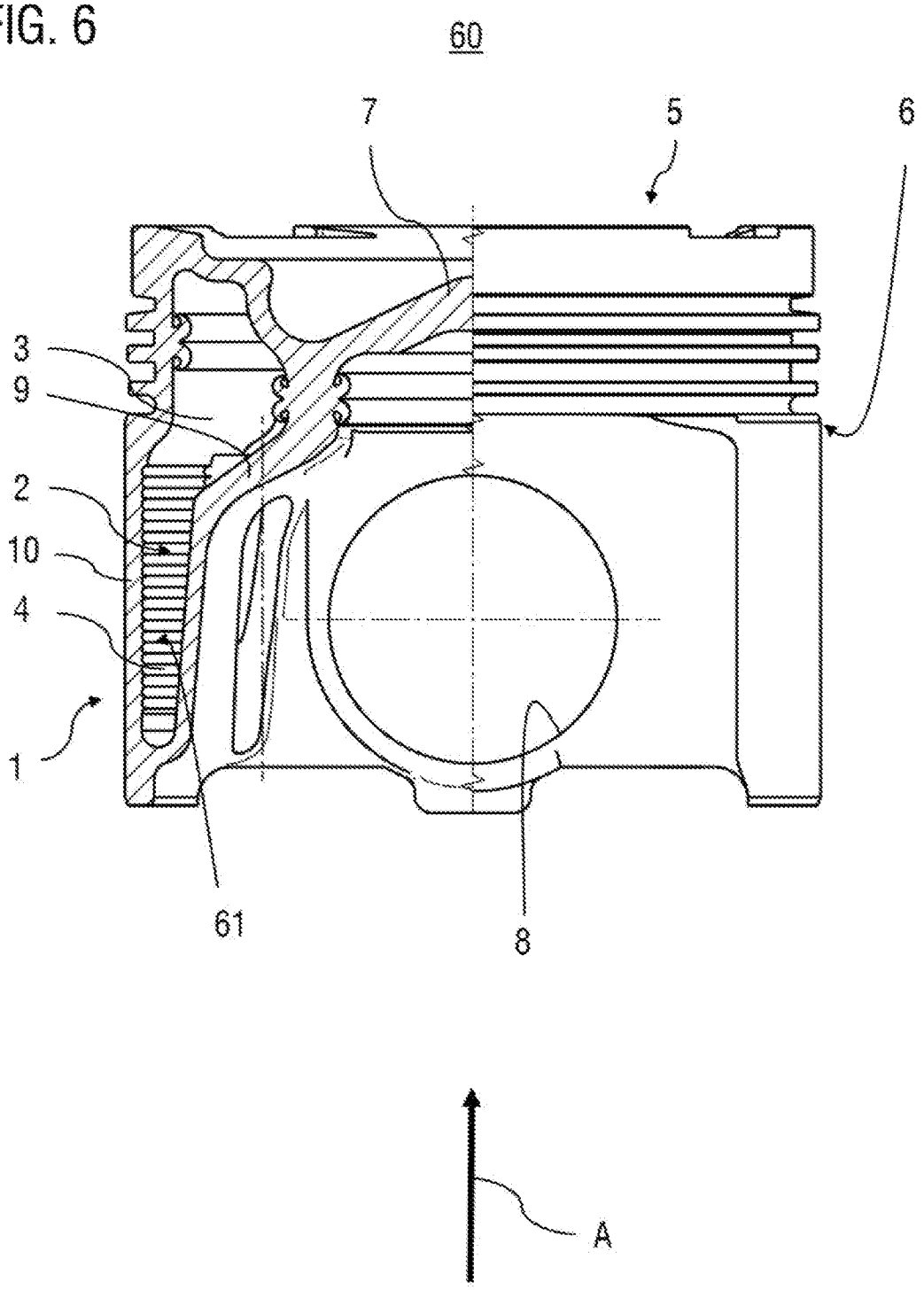
FIG. 6 shows a subsection of a piston according to a further aspect of the present disclosure.

FIG. 6 illustrates a fifth exemplary aspect of a piston 60. The special feature of this exemplary aspect lies in the fact that the inner side of the wall 10 of the piston barrel has a profiling 61. The profiling is, in the present case, in the form of a rib structure. In this way, the surface area on the inner side of the wall 10 of the piston barrel 1 is enlarged, whereby the heat transfer from oil to the wall 10 of the piston barrel 1 is increased.

Figure 7:
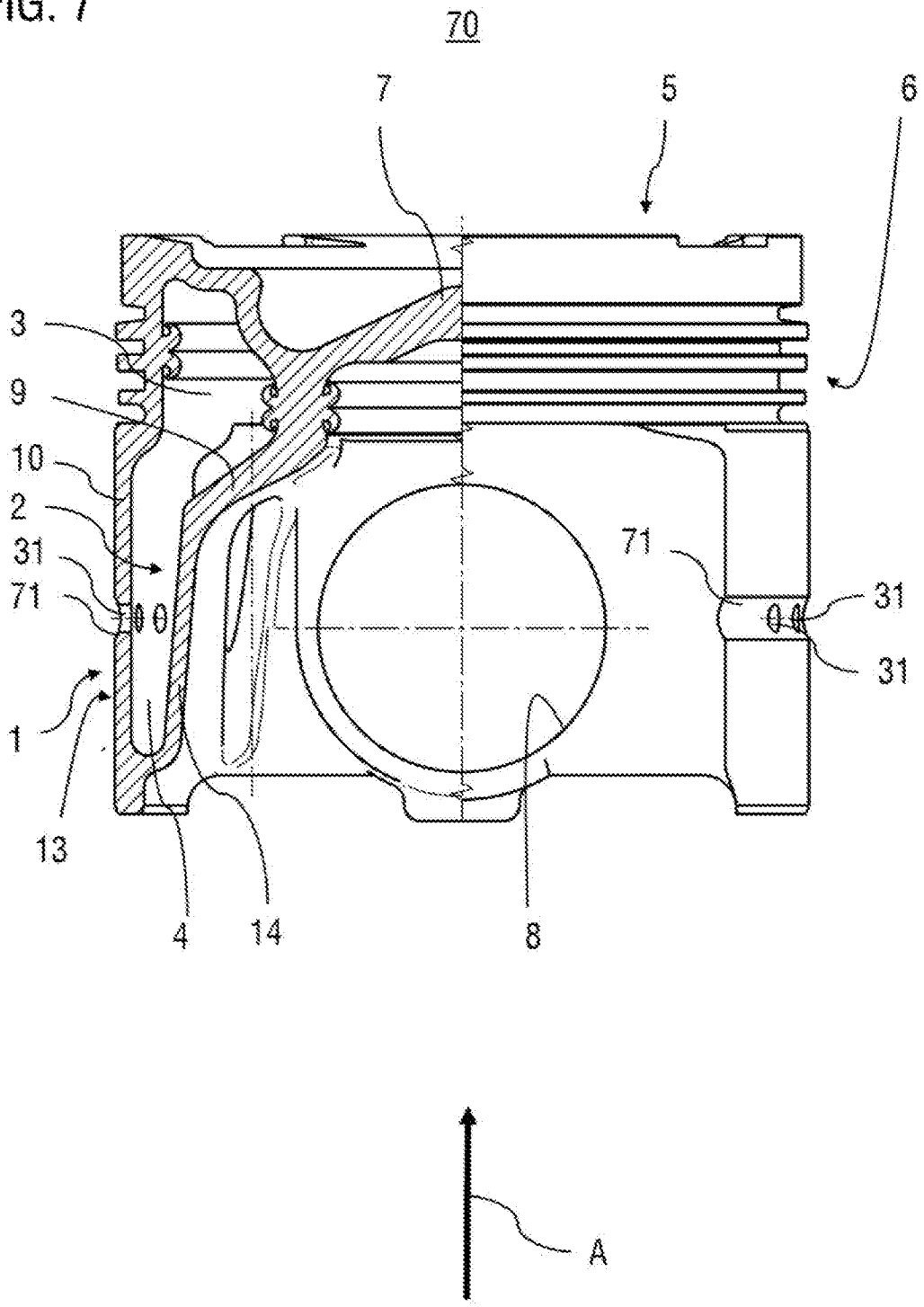
FIG. 7 shows a subsection of a piston according to a further aspect of the present disclosure.

A sixth aspect of a piston 70 is illustrated in FIG. 7. The special feature of said aspect lies in the fact that a depression 71 in the form of an encircling groove or notch which surrounds the passage openings 31 is provided on the outer side 13 of the wall 10 of the piston barrel 1. Said depression 71 has the effect that oil emerging through the passage openings 31 at the cylinder liner is distributed more effectively. This in turn accelerates the heating of the oil film of the cylinder liner and this leads to a faster and more effective reduction of the piston barrel friction.

Figure 8:
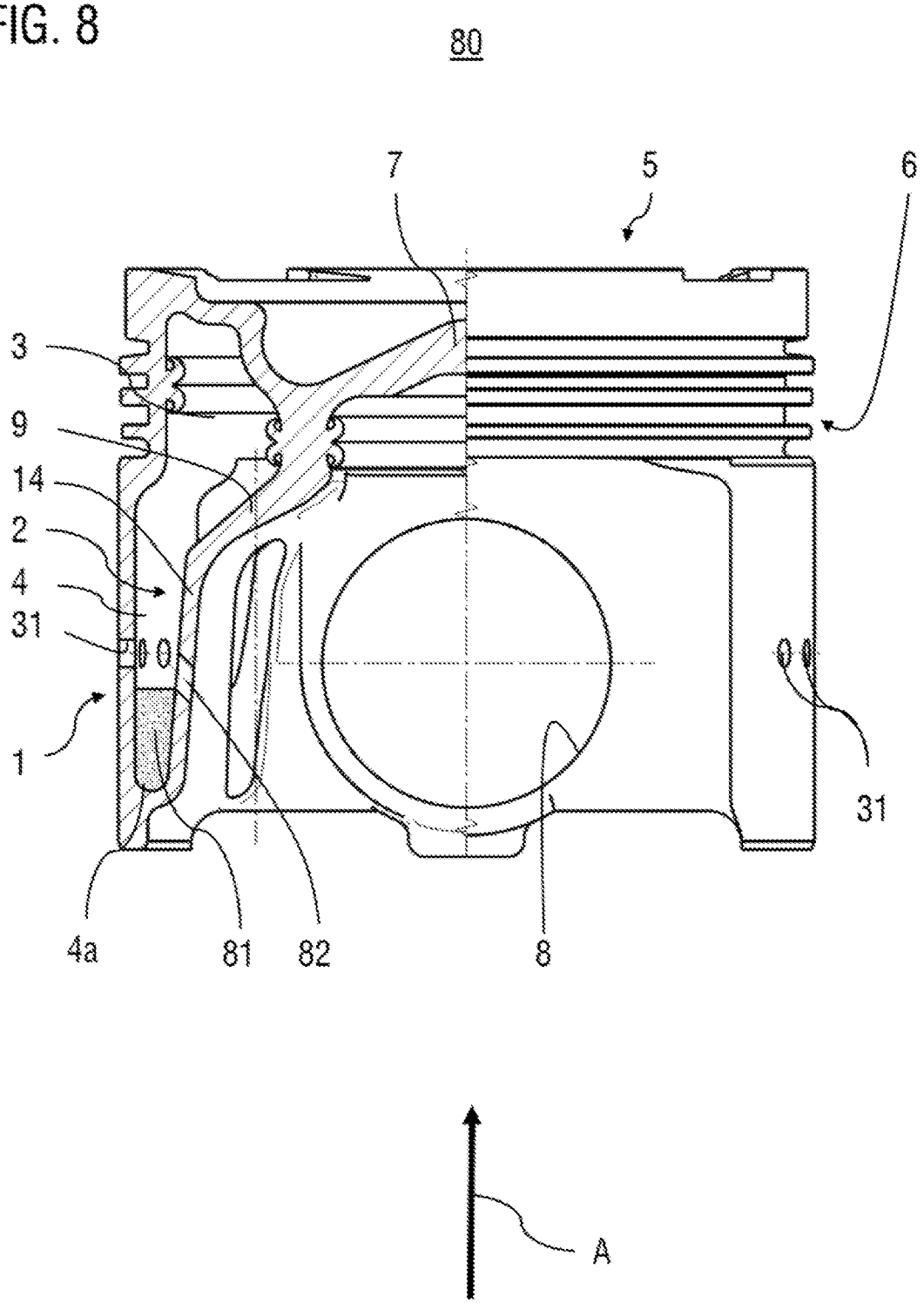
FIG. 8 shows a subsection of a piston according to a further aspect of the present disclosure.
Figure 9:
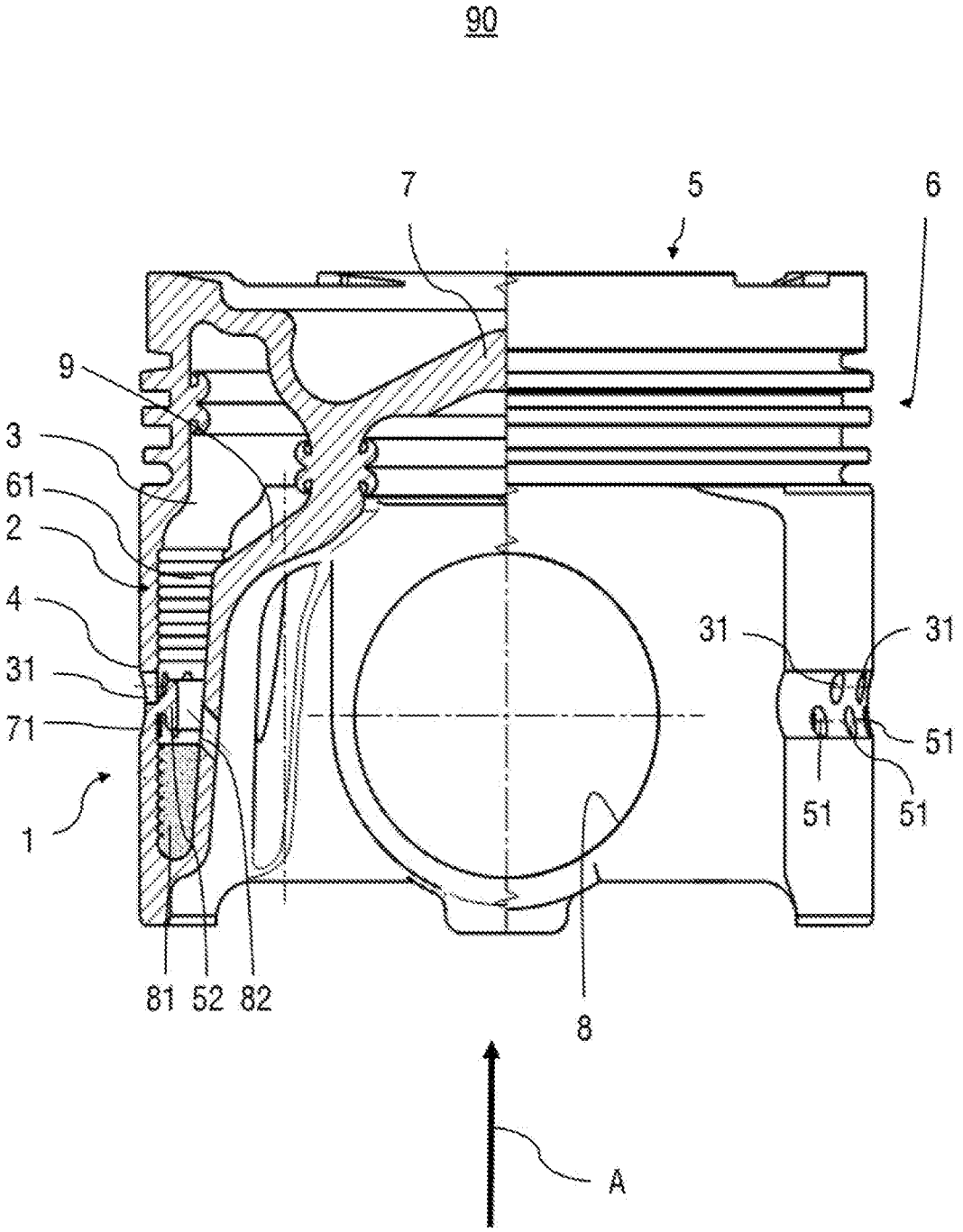
FIG. 9 shows a subsection of a piston according to a further aspect of the present disclosure.

FIG. 8 illustrates a seventh aspect of a piston 80. The special feature of said aspect lies in the fact that a passage opening 82 (lubricant return bore) is arranged on the inner side of the cooling duct 2. The lubricant return bore 82 is in particular arranged so as to be spaced apart from the lower end 4*a* of the lower region 4 of the cooling duct and at the same time below the passage openings 31 by way of which the cooling duct is fluidically connected to the cylinder liner. The oil level of the lubricant reservoir 81 can be set through the specification of the axial height of the lubricant return bore 82. Via the lubricant return bore 82, the lubricant that is flung back and forth in the cooling duct 2 can flow back into the piston interior space again, and in this way, can be supplied to the lubricant circuit again. The lubricant return bore 82 is of obliquely downwardly sloping form, which offers advantages from a production aspect, because in this way, no angle drill is required for the formation of the lubricant return bore 82.

It is emphasized that the design variants shown in FIGS. 2 to 8 may be combined with one another in any desired manner. This is illustrated for example on the basis of the design variant of a piston 90 shown in FIG. 9, in which multiple of the above-described advantageous design variants have been combined in one aspect.

Even though the present disclosure has been described with reference to particular exemplary aspects, it is self-evident to a person skilled in the art that numerous alterations may be made, and equivalents used as substitutes, without departing from the scope of the present disclosure. Furthermore, numerous modifications may be made without departing from the associated scope. Consequently, the present disclosure is not intended to be restricted to the exemplary aspects disclosed, but rather is intended to encompass all exemplary aspects which fall within the scope of the appended patent claims. In particular, the present disclosure also claims protection for the subject matter and the features of the subclaims independently of the claims referred back to.

LIST OF REFERENCE DESIGNATIONS

1 Piston barrel
2 Cooling duct
3 Upper section
4 Lower section
5 Piston head
6 Ring belt
6*a* Ring groove
7 Piston depression
8 Pin bore
9 Transition wall section
10 Wall of the piston barrel
11 Oil-film-temperature-dependent piston barrel friction at 1200 rpm
12 Oil-film-temperature-dependent piston barrel friction at 1800 rpm
13 Outer surface
14 Wall
15 Edge
20 Piston
30 Piston
31 First passage opening
31*a* Lower edge
40 Piston
41, 52 Oil-catching rib
42, 54 First section of the oil-catching rib
42*a* Oil-intercepting surface
43, 53 Second section of the oil-catching rib
50 Piston
51 Second passage opening
60 Piston
61 Profiling
70 Piston
71 Depression
80 Piston
81 Lubricant
82 Lubricant return bore
90 Piston
A Axial direction

We claim:

1. A piston for a reciprocating-piston internal combustion engine, comprising:

a piston head including an encircling ring belt with at least one ring groove configured for receiving a piston ring;

a piston barrel;

a cooling duct including an encircling upper cooling duct portion formed in the region of the ring belt, and a lower cooling duct portion duct extending from the ring belt as far as a wall of the piston barrel;

wherein the lower cooling duct portion is, in the region of the wall of the piston barrel, in fluid communication by way of at least one first passage opening to a cylinder liner for the piston; and an oil-catching rib arranged in the cooling duct such that a part of the oil flung back and forth in the cooling duct as a result of the piston movement strikes the oil-catching rib and is conducted by the oil-catching rib to the at least one first passage opening.

2. The piston according to claim 1, wherein the cooling duct extends as far as a lower end region which is averted from the ring belt, of the wall of the piston barrel.

3. The piston according to claim 1, further comprising:

at least one pin bore for receiving a piston pin formed in the piston barrel, wherein the cooling duct extends in the axial direction of the piston as far as the level of the at least one pin bore.

4. The piston according to claim 1, further comprising:

at least one pin bore for receiving a piston pin formed in the piston barrel, wherein the cooling duct extends in the axial direction of the piston as far as a lower end of the pin bore.

5. The piston according to claim 1, wherein the at least one first passage opening is arranged in the middle of the height of the piston barrel in the axial direction.

6. The piston according to claim 1, wherein the oil-catching rib is arranged at the level of or directly adjacent to the at least one first passage opening.

7. The piston according to claim 1, wherein a lower edge of the first passage opening is arranged so as to be downwardly offset with respect to a horizontal oil-intercepting surface of the oil-catching rib.

8. The piston according to claim 1, wherein the passage opening is a passage bore which extends into a region of the oil-catching rib and which forms a duct-like recess there.

9. The piston according to claim 1, wherein the cooling duct is, in the region of the wall of the piston barrel, is in fluid communication with the cylinder liner by way of at least one second passage opening, wherein the at least one first passage opening and the at least one second passage opening are arranged in each case on opposite sides of the oil-catching rib in the axial direction of the piston.

10. The piston according to claim 1, wherein the oil-catching rib has a first section, which runs in encircling fashion on the wall of the piston barrel and which extends in the radial direction of the piston, and a second section, which extends in the axial direction of the piston and which is arranged at that end region of the first section which is averted from the wall of the piston barrel.

11. The piston according to claim 10, wherein the second section of the oil-catching rib extends in the axial direction both in the direction of the piston head and in the opposite direction.

12. The piston according to claim 1, wherein the wall of the piston barrel has a profiling on a side facing toward the cooling duct, and the profiling is formed by a channel structure.

13. The piston according to claim 1, wherein the piston barrel has, on its outer surface, a depression, which surrounds an end region of the at least one first passage bore and by way of which lubricant which emerges from the end region of the first passage opening is distributed between cylinder liner and piston barrel.

14. The piston according to claim 1, further comprising a lubricant return bore on a wall of the cooling duct, which wall is arranged so as to be situated opposite the piston barrel, wherein the lubricant return bore is arranged, in the axial direction of the piston, so as to be spaced apart from the lower end of the cooling duct and below the at least one first passage opening.

15. The piston according to claim 14, wherein the lubricant return bore runs obliquely downward from the wall of the cooling duct to a piston interior space.

16. The piston according to claim 1, further comprising:

a) a transition wall section of the cooling duct, wherein:

a1) the transition wall section is arranged on that side of the cooling duct which faces toward the piston inner side and a2) the transition wall section connects an upper region of the cooling duct, which is formed in encircling fashion in the region of the ring belt, to a lower region of the cooling duct, which adjoins the wall of the piston barrel, and a3) has a section which runs obliquely downward toward the piston barrel and which is adjoined, in the lower region of the cooling duct, by a wall of the cooling duct, which wall runs downward more steeply in relation to said section and is arranged so as to be situated opposite the piston barrel, and b) wherein the transition region between the wall section of the cooling duct and the wall which runs downward more steeply in relation to said section forms an edge.

17. An arrangement, comprising:

a) a piston including a piston head having an encircling ring belt with at least one ring groove configured for receiving a piston ring, a piston barrel, and a cooling duct including an encircling upper cooling duct portion formed the region of the ring belt, and a lower cooling duct portion extending from the ring belt as far as a wall of the piston barrel wherein the lower cooling duct portion is, in the region of the wall of the piston barrel, in fluid communication by way of at least one first passage opening to a cylinder liner for the piston; and an oil-catching rib arranged in the cooling duct such that a part of the oil flung back and forth in the cooling duct as a result of the piston movement strikes the oil-catching rib and is conducted by the oil-catching rib to the at least one first passage opening;

b) a volume-flow-regulated lubricant pump which is provided for the supply of lubricant to the piston; and c) a control device of the lubricant pump, wherein the control device is designed such that, in a manner dependent on an operating parameter of an internal combustion engine, from which operating parameter the present engine load can be derived, said control device controls or regulates a lubricant volume flow for the supply of lubricant to the piston such that, in the presence of a first value of the operating parameter, which corresponds to a first engine load, a first volume flow is set, and in the presence of a second value of the operating parameter, which corresponds to a second engine load greater than the first engine load, a second volume flow is greater than the first volume flow.

18. A motor vehicle, comprising:

a reciprocating-piston internal combustion engine;

at least one piston including, a piston head having an encircling ring belt with at least one ring groove configured for receiving a piston ring;

a piston barrel;

a cooling duct comprising an encircling upper cooling duct portion formed in the region of the ring belt, and a lower cooling duct portion wherein the cooling duct extends from the ring belt as far as a wall of the piston barrel, wherein the lower cooling duct portion is, in the region of the wall of the piston barrel, in fluid communication by way of at least one first passage opening to a cylinder liner for the piston; and an oil-catching rib arranged in the cooling duct such that a part of the oil flung back and forth in the cooling duct as a result of the piston movement strikes the oil-catching rib and is conducted by the oil-catching rib to the at least one first passage opening.

* * * * *